US005308308A

United States Patent [19]

Bauman

[11] Patent Number: 5,308,308

[45] Date of Patent: May 3, 1994

[54] METHOD OF CARDHOLDER AND POCKET CONSTRUCTION

[75] Inventor: Thomas A. Bauman, West Bend, Wis.

[73] Assignee: Enger-Kress Company, West Bend, Wis.

[21] Appl. No.: 976,462

[22] Filed: Nov. 2, 1992

Related U.S. Application Data

[62] Division of Ser. No. 660,200, Feb. 25, 1991, Pat. No. 5,184,658.

[51] Int. Cl.[5] ..... B31B 41/14; B31B 41/64

[52] U.S. Cl. ..... 493/199; 493/189; 493/931

[58] Field of Search ..... 493/133, 137, 138, 139, 493/189, 199, 200, 223, 350, 931, 947

[56] References Cited

U.S. PATENT DOCUMENTS

| | | | |
|---|---|---|---|
| 2,353,402 | 7/1944 | Haslacher | 493/199 |
| 3,195,424 | 7/1965 | Camerini | 493/199 |
| 4,671,332 | 6/1987 | McPhee | 493/931 |
| 4,764,159 | 8/1988 | Mitsuyama | 493/947 |

*Primary Examiner*—William E. Terrell
*Attorney, Agent, or Firm*—Wheeler Law Firm

[57] ABSTRACT

A card display pocket formed of three sheets of fusible material. The first sheet is a nylon/vinyl material that is slit one way to receive the second sheet of a frosty vinyl material which may be slit a different way from the first sheet to form specially designed pockets and woven through the first sheet of material, over the front side of the first sheet of material and under the back side of the first sheet of material. The third sheet is a plain vinyl that is used for a backing.

The method of construction is as follows: In a sheet of nylon/vinyl material slits are made lengthwise or widthwise through the material so that they are either generally parallel to each other or generally perpendicular to each other. Translucent vinyl material, is then interwoven through these slits in order to form the desired pockets. The card pocket with curved sides is especially desirable for applications where a card is frequently accessed. A portion of frosty vinyl material is left on the vinyl side of the nylon-vinyl material. That material is then fused to the vinyl side of the nylon-vinyl material and to a third sheet of opaque vinyl material which forms a complete seal and lines the pocket assembly and strengthens the pocket.

7 Claims, 4 Drawing Sheets

METHOD OF CARDHOLDER AND POCKET CONSTRUCTION

This is a division, of application Ser. No. 07/660,200, filed Feb. 25, 1991, U.S. Pat. No. 5,184,658.

BACKGROUND OF THE INVENTION

This device is related to the field of displaying any sort of card in a cardholder or billfold or portfolio or other item construction. The objective of this device is to provide a simple method whereby an item having interior fabric pockets or lining materials may be constructed by the interweaving of the materials out of which the item is constructed thereby producing a neat, clean appearance for the display of any sort of card while at the same time providing positive location of the card pocket and reinforcing the structure of the item in which the pocket assembly is used. The inventor knows of no prior art which either teaches or reveals the invention disclosed herein.

U.S. Pat. No. 1,619,543 (R. H. Rolfs et al) discloses a billfold having a transparent pocket. Parts are shown as held in place and then stitched together. It discloses a single piece construction in that the billfold itself or rather the billfold material is one piece that is folded and then stitched. No interweaving of parts is disclosed. No method for interweaving of the parts is disclosed nor is any fusing disclosed.

U.S. Pat. No. 1,684,737 (C. L'Enfant) discloses a card case and method for making same. The card case discloses multiple windows which are used to display different cards. In essence the patent discloses extending of celluloid, forming the windows of the card case, through the entire length of the device. The patent discloses formation of two celluloid windows from a single strip of material. The patent discloses mitering of the folded corners of the celluloid material and also indicates that cards may be examined on either side without removal from the card case. The side edges of the case are stitched and not fused. The joined edges are taught to be, preferably, perforated to facilitate the folding of the parts into proper position. Essentially the celluloid windows form the leaves of a book. There is no interweaving of materials taught or suggested by L'Enfant. The celluloid windows are shown as being connected or slipping through a central dividing point of the billfold; which then forms the binding of the billfold.

U.S. Pat. No. 2,384,199 (Sherwood) discloses a billfold which is constructed out of a single piece of material wholly devoid of stitching. The folds are designed to allow the billfold to be constructed by inserting tabs into various parts of the billfold to create the construction. The tabs are specifically identified as reenforcing the structure of the billfold. Each tab, after being put in place, is cemented in place. Again fusing is not specifically disclosed nor is the interweaving of the materials.

U.S. Pat. No. 2,431,472 (Fistell) discloses a patent for a folding holder for papers. The papers described are maps and the like. The patent does not disclose fusing or the use of slits to allow interweaving of the materials. The foldability of the device is the primary feature. A back portion of the Fistell invention is provided with cutouts to form frames. However these cutouts are different from our slits in that, again, no interweaving is disclosed to show the formation of the pockets. Clear material is used to occupy the cutout area. The space sheets forming the face of the holder are cellophane or a plastic polymerized vinyl compound. This means that the fabric used is coated however no fusing or welding of the materials is indicated or taught. Certainly the method of weaving through slits is not revealed.

U.S. Pat. No. 2,452,096 (Bertalotto) discloses a combined a billfold and card retainer. The major purpose of this invention is to provide a novel combined billfold and card retainer which will have a pair of compartments, separate from each other, intended for the reception of documents or whatever the user wishes to put in them. A further goal is to allow a substantial portion of the cards held by this billfold to be seen. This patent does not discuss interweaving of materials by the use of slits cut in the material. Overlapping of pockets is disclosed but this overlapping is not the same as the interweaving of the two materials through the slits. Rather this is an overlapping of the card pockets so that one portion of a card will slide down another portion of a card as it is held in this billfold. The interweaving method and structure are not disclosed.

U.S. Pat. No. 2,535,387 (Broughton) discloses a billfold that is adapted to receive a removable pass case. This device shows a bridging wall construction. There are two structures disclosed: a first structure that is a billfold that is designed to be folded together by the use of tabs which slide into slits to construct the billfold, and a second structure, a pass case, which may then be attached to the formed billfold again by the use of tabs which are placed in slits. No interweaving of these two parts is shown. They are merely connected by the tabs. Fusing of the parts is not disclosed. Essentially the two parts interlock with each other by means of the tabs.

Accordingly, the use of tabs to interlock two parts of a billfold is taught but the use of slits to interweave two materials to form pockets in a billfold is not taught. The pockets are not formed by the interlocking of the two parts. The folding of the billfold creates a structure having pockets but it is not done, at all, in the same manner as the present invention.

U.S. Pat. No. 2,403,507 (Davio) discloses a billfold. The major feature of this device is the use of expandable pockets. The specifically disclosed objective of this invention is to provide a billfold which can be constructed of a unitary blank to form one or more expandable pockets without the use of stitching, adhesive or the like. The blank of this invention that is used to form the billfold is designed to fold up so that its tabs will be received in slits at specific portions on the blank. This folding process creates the billfold. This invention discloses the use of flaps that are folded upon portions 8 of the billfold and that are folded also upon interportions of the billfold in order to provide expandable superimposed pockets. The tabs do not define the pocket form by interaction with the slit contours. This is different from the interweaving structure of the present invention. This patent further discloses that portions 8 may be cut out to provide a window in the expandable pocket and that the window may be provided with a transparent sheet which may be retained in place by a flap that is folded inwardly over the end of the sheet. Again this entire structure is directed towards the use of folds and tabs to create the structure of a bill fold. No fusing or interweaving of the parts in disclosed and in fact the use of adhesives is specifically taught away from in this invention. No interweaving of separate materials to form the billfold is disclosed.

U.S. Pat. No. 2,777,494 (Anderson) discloses a billfold structure. Again this billfold structure is chiefly noted for having expandable pockets. Again this patent discloses the use of tongues inserted into slits to interlock these specific parts of the structure of the billfolds but not to interact with slits to define pocket forms. The tongues are glued in position on the inner side of the panel 16 in the manner shown in FIG. 8. The layers of material in some parts of the structure are stitched together. However, it is apparent that no interweaving or fusing of materials is disclosed by this patent.

Finally, U.S. Pat. No. 3,565,148 (Miller) discloses a multiple pocket wallet. The invention is a wallet of thin flexible material for credit cards and the like. The wallet is formed from three panels to provide two rows of pockets separated by a longitudinal fold line. A transverse fold line extends across the middle of the wallet between adjacent pockets to allow the wallet to be folded along one of the fold lines and then along the other fold line into a convenient size for carrying in a person's pocket. Heat sealing or fusing one panel to another is disclosed by Miller. It is further disclosed that these transverse "weld lines" help to strengthen the fold lines. The panels are disclosed as lying on opposite sides of each other. Further the use of weld lines to give a stitched appearance is disclosed. This is disclosed as is "common in plastic goods of this sort". However the interweaving of materials to form the pockets is not disclosed. Neither are the use of slits disclosed.

SUMMARY OF THE INVENTION

A method for constructing a pocket assembly in a wallet or cardholder or portfolio or other item, which has additional pockets for displaying credit cards or business cards or other articles, made from a first fusible material, that is to be used to form an inside pocket assembly of the item; having a front nylon side and a back fusible vinyl side, a second transparent or translucent fusible vinyl material, which forms pockets for any cards, and a third opaque fusible vinyl material which forms a lining for the pocket assembly, the method comprising: a first step in which slits of desired shape and size are made through the first fusible material, a second step in which a second fusible material, having at least one dimension of size equal to the size of the slits in the first fusible material, is slid through the slits of the first fusible material so that a portion of the second fusible material covers the front side of the first fusible material and a portion of the second fusible material is in contact with the backside of the first fusible material; a third step which positions the third fusible material in contact with the back side of the second fusible material; a fourth step in which the portion of the second fusible material in contact with the backside of the first fusible material is fused to the back side of the first fusible material and the front side of the third fusible material so that the card pockets of the item are produced. Depending upon the type of pocket design desired, the second fusible material, in the second step of the above procedure may also be slit, usually in a different way from the slits in the first fusible material, so that pockets having more complex shapes may be incorporated into the item.

The device formed by the above method is preferably comprised of three sheets of plastic material. The first sheet is preferably a generally opaque plastic material, which forms the inside of the cardholder, and is slit, usually along a line, a plurality of times. The second sheet is a generally transparent or translucent plastic material, which forms a wall of the pocket, and, depending upon the type of pocket design desired, may be slit a different way from the slits made in the first sheet. The second sheet is woven through the slits of the first sheet and the two sheets together form a unique pocket for cards, or the like. The portions of the second sheet in contact with the backside or side of the first sheet that is not to be seen by the user of the cardholder are fused to the backside of the first sheet. A third sheet of plastic material may then be fused over the back side of the first sheet as an optional backing to provide additional strength to the cardholder. The sealing is done on the assembly after interweaving the first and second plastic sheets as required so that the slits produce a very neat construction. The construction is designed to allow a neat look and strength as well as appearance for use in wallets and credit holders for holding cards.

The construction makes it possible to have a rich nylon look while utilizing a relatively inexpensive way to fuse the materials. The neat appearance is apparent and the slit construction allows for positive location of the resulting card display pockets. The vinyl lining material assures proper seals as well as providing a smooth, finished pocket assembly interior and reinforcement. On the particular application in the drawings, the bottom edge of the nylon/vinyl material is gauge turned and sewn over this reinforcement to provide a rich, finished look.

Many of the advantages of this card display pocket construction are also possible when the pocket is put right into nylon/vinyl cover lining material rather than into an interior pocket assembly. Similarly, the construction still has advantages in a construction where the first material is fusible sheet vinyl. If the outside cover material in an item is fusible, display pockets can be accurately positioned to the outside of an item using this construction. Typically when the first and second material are both fully fusible, the third material is only necessary if a smooth back is needed.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
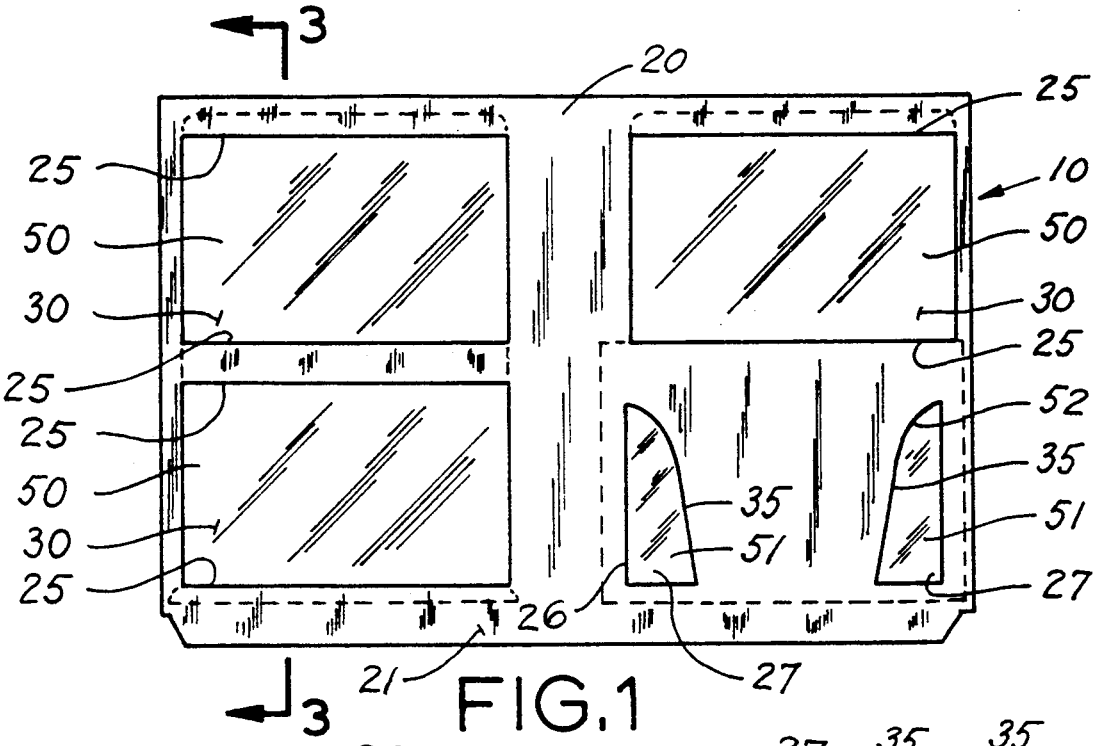
FIG. 1 is a front plan view of the cardholder.
Figure 2:
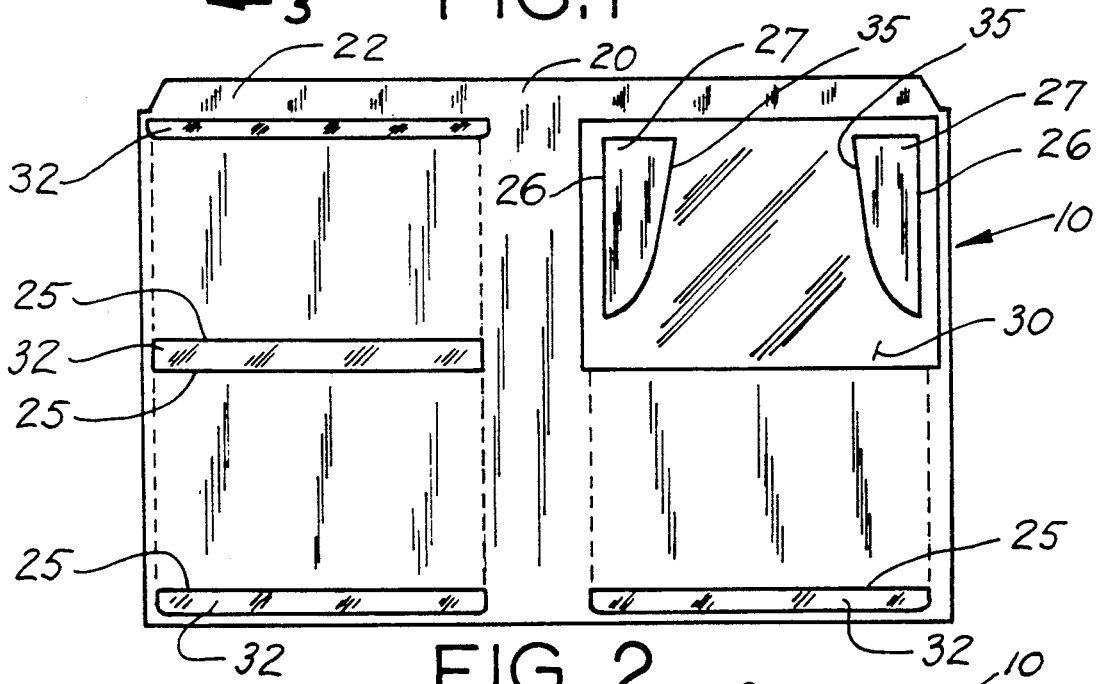
FIG. 2 is a back plan prefusion view of the cardholder.
Figure 3:
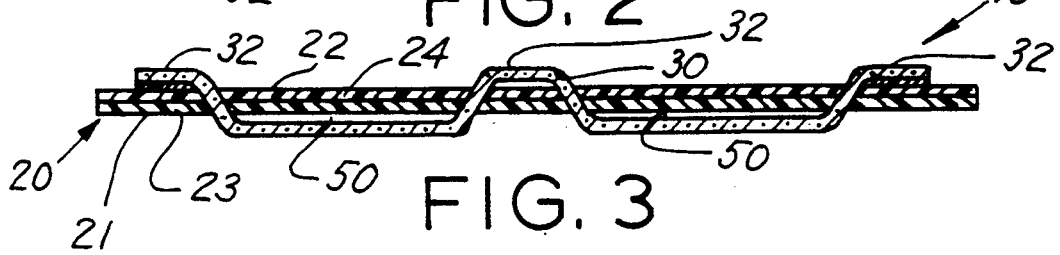
FIG. 3 is a sectional view from line 3—3 of FIG. 1.
Figure 4:
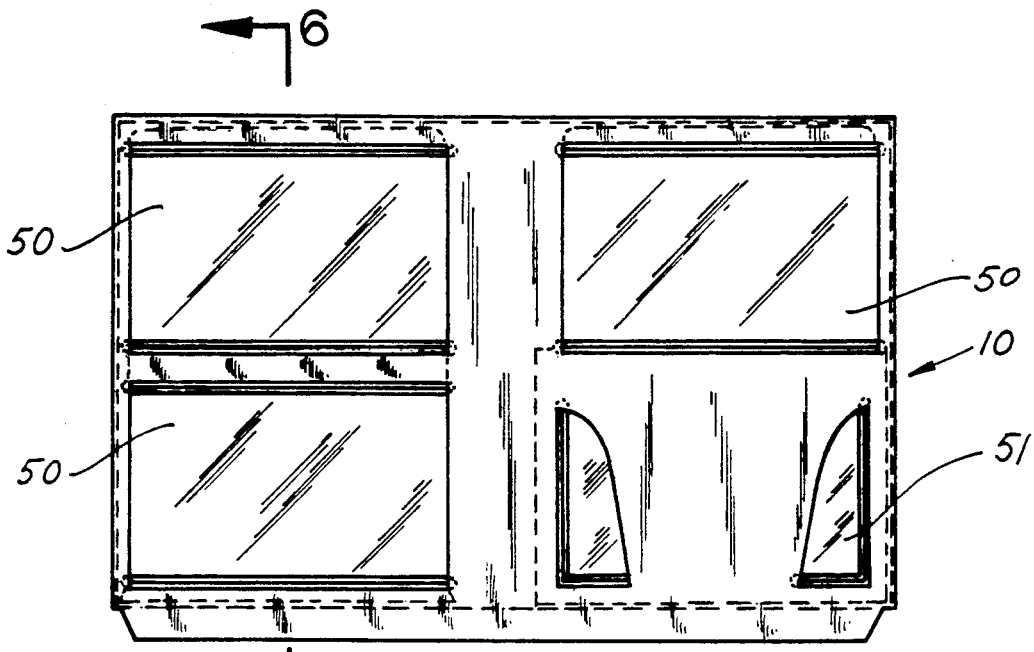
FIG. 4 is a front elevational view of a completed cardholder.
Figure 5:
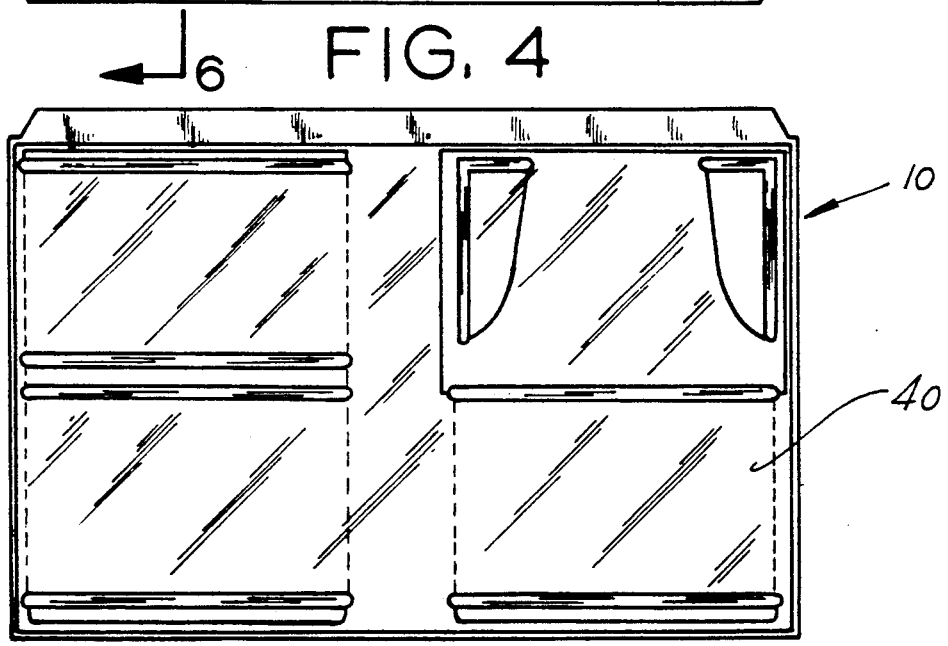
FIG. 5 is a rear elevational view of a completed cardholder.
Figure 6:
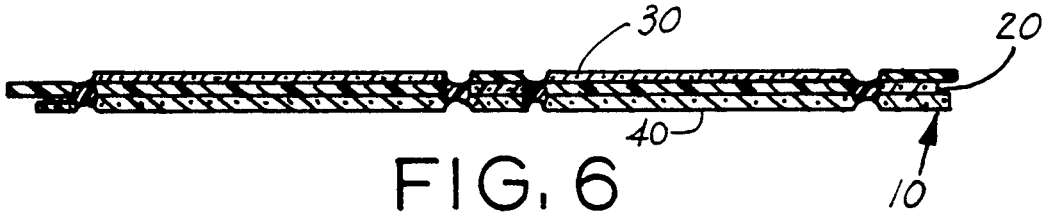
FIG. 6 is a sectional view from line 6—6 of FIG. 4.
Figure 7:
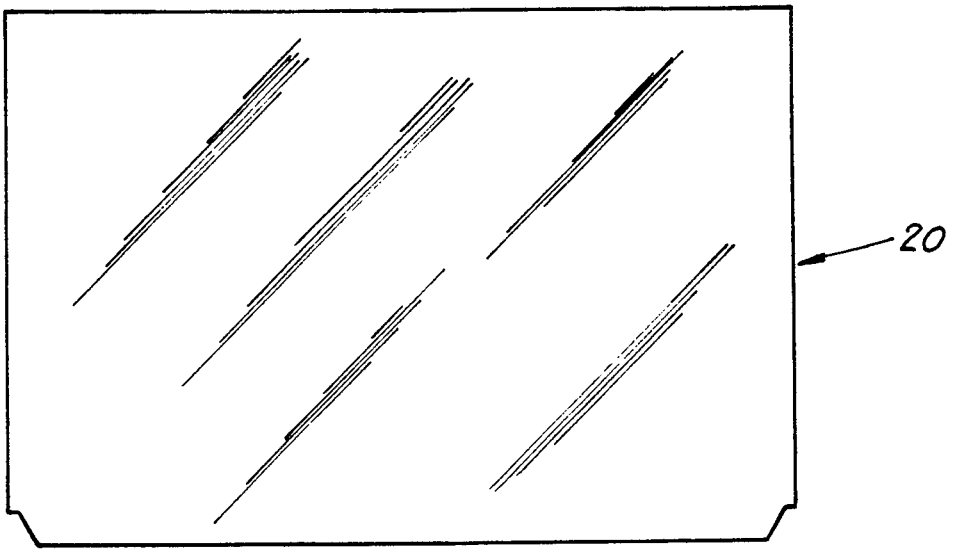
FIG. 7 is a view of the first sheet of fusible material before slitting.
Figure 8:
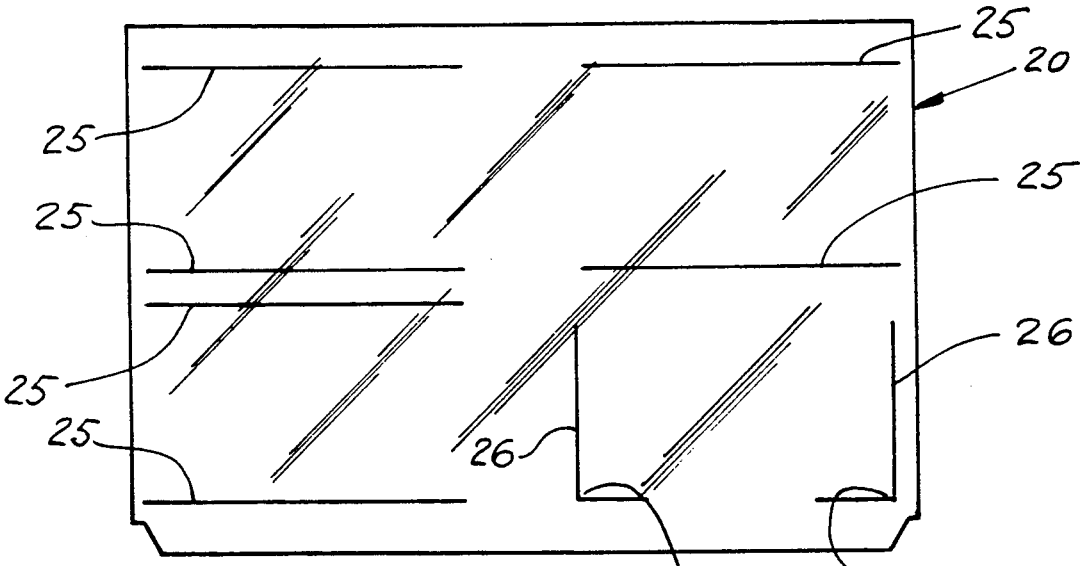
FIG. 8 is a view of the first sheet of fusible material after slitting.
Figure 9:
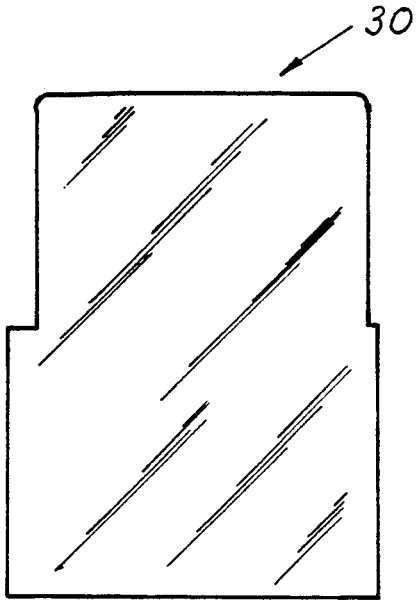
FIG. 9 is a view of an alternative second sheet of fusible material before slitting.
Figure 10:
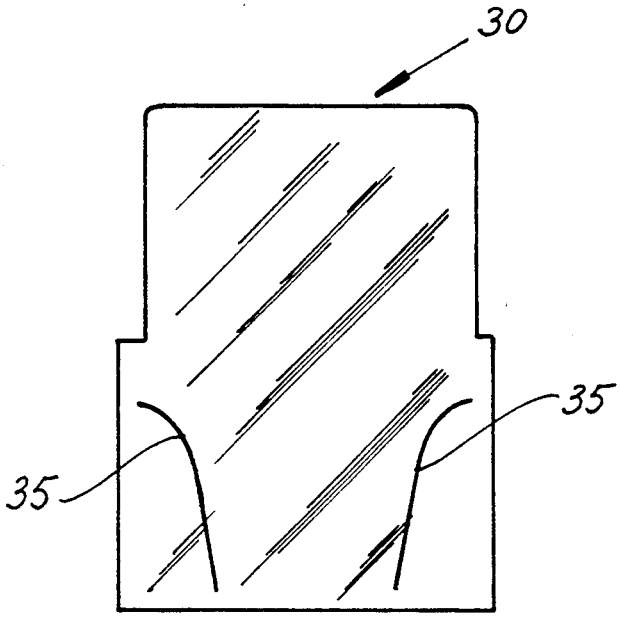
FIG. 10 is a view of an alternative second sheet of fusible material after slitting.
Figure 11:
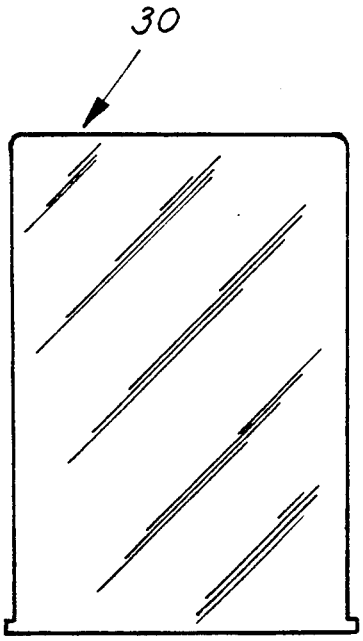
FIG. 11 is a view of a second sheet of fusible material.

For the purposes of simplicity the cardholder or other similar type item shall be referred to as the item 10 in the rest of the specification. The structure of the intermediate item 10 may be seen in FIGS. 1–3. The structure of the completed item 10 may be seen in FIGS. 4–6. The structure of the item 10, as may be seen in the FIGS. 1–6, consists essentially of a first sheet 20 having a front side 21 of nylon material 23 and an integral back side 22 of a vinyl plastic material 24, a second sheet 30, and a third optional sheet 40. The first sheet 20 has slits 25 through which the second sheet 30 is woven or passed through, going over the front side 21 and under the back side 22 of the first sheet, in order to form pockets 50. The second sheet 30, as shown in the drawings, may also have slits 35 added in order to produce specially designed pockets 50; for example pocket 51 having crescent shaped corners 52 may be made by making two right angle slits 26 in the first sheet 20 and two crescent shaped slits 35 in the second sheet 30 so that the corners 27 of the right angle slits 26 of the first sheet 20 are slid through the crescent slits 35 on the second sheet 30 and the pocket 51 is formed.

The method for constructing the interior pocket portions of the item 10 comprises a first step in which the first sheet 20 having a front side 21 of nylon material 23 and an integral back side 22 of a vinyl plastic material 24 has slits 25 cut through it. Then the second step is performed, in which the second sheet 30 is interwoven through the slits 25 of the first sheet 20, over the front side 21 and under the back side 22 of the first sheet 20, to form pockets on the front 21 of the nylon material 23. In the third step the portions 32 of the second sheet 30 are left in contact with the back side 22 of the first sheet 20 and are fused to the vinyl plastic 24 by means of the application of dielectric or other fusing means. An optional fourth step may then be performed in which a third sheet 40 of plastic material is applied over the portions 32 of the second sheet 30 of translucent vinyl material and the back side 22 of the first sheet 20, and fused to the back side 22 and the portions 32 of the second sheet located on the back side 22, so that the structure of the item 10 is further strengthened.

Further, if a special type of pocket appearance is desired, an additional optional step, may be added between the first and second steps, in which the second sheet 30 is slit a different way from the slits 25 of the first sheet. This allows the further interweaving or intersecting of the second sheet 30 with the first sheet 20 to produce specially designed pockets as described above.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A method for constructing a pocket assembly that is to be used in an item for holding cards, from a first sheet of fusible material having a front side and a back side and a second sheet of fusible material having a front side and a back side, said method comprising:

a first step in which slits of a length at least equal to one dimension of the second sheet of fusible material are made through said first sheet of fusible material;

a second step in which said second sheet of fusible material is slid through said slits, with the back side of said second sheet of fusible material facing and passing over said front side of said first sheet of fusible material and with the front side of said second sheet of fusible material facing and passing under said back side of said first sheet of fusible material at least one time, and at least one portion of the front side of said second sheet of fusible material being in contact with a portion of said back side of said first sheet of fusible material; and a third step in which said portion of said second sheet of fusible material in contact with said portion of said back side of said first sheet of fusible material is fused to said portion of said back side of said first sheet of fusible material so that interior pockets of the pocket assembly are produced.

2. The method of claim 1 wherein the item for holding cards is a wallet.

3. The method of claim 1 wherein the item for holding cards is a pocketbook.

4. The method of claim 1 wherein the item for holding cards is a cardholder.

5. A method for constructing a pocket in a cardholder, from a first, sheet of fusible material having a front side and a back side, and a second sheet of fusible material having a front side and a back side, the method comprising: a first step in which slits of desired size are made through the first sheet of fusible material; a second step in which the second sheet of fusible material, having at least one dimension of size equal to the size of the slits in the first sheet of fusible material, is slid through the slits of the first sheet of fusible material, over the front side of the first sheet of fusible material with the back side of the second sheet of fusible material facing the front side of the first sheet of fusible material and under the back side of the first sheet of fusible material with the front side of the second sheet of fusible material facing the back side of the first sheet of fusible material, so that a first portion of the second sheet of fusible material covers the front side of the first sheet of fusible material and a second portion of the second sheet of fusible material is in contact with the back side of the first sheet of fusible material; and a third step in which the second portion of the second sheet of fusible material in contact with the back side of the first sheet of fusible material is fused to the back side of the first sheet of fusible material so that interior pockets are produced.

6. The method of claim 5 wherein the cardholder is a wallet.

7. The method of claim 5 where in the cardholder is a pocketbook.

* * * * *